US006079422A

United States Patent [19]

Drago et al.

[11] Patent Number: 6,079,422

[45] Date of Patent: Jun. 27, 2000

[54] HAIR CURLER

[76] Inventors: JoAnn K. Drago; James M. Drago, both of 125 Ponderosa Way, Jacksonville, Oreg. 97530

[21] Appl. No.: 09/333,699

[22] Filed: Jun. 16, 1999

Related U.S. Application Data

[60] Provisional application No. 60/105,761, Oct. 26, 1998.

[51] Int. Cl.[7] ..... A45D 2/20

[52] U.S. Cl. ..... 132/247; 132/246; 132/245; 219/222

[58] Field of Search ..... 132/247, 245, 132/246, 269, 271, 233, 232, 229; 219/222, 225, 242

[56] References Cited

U.S. PATENT DOCUMENTS

| | | | |
|---|---|---|---|
| 1,240,508 | 9/1917 | Stevenson | 132/247 |
| 2,137,595 | 11/1938 | Stubbs et al. | 132/247 |
| 2,549,446 | 4/1951 | Frishberg | 132/247 |
| 4,955,401 | 9/1990 | Parsons | 132/262 |
| 5,025,816 | 6/1991 | Jones | 132/247 |
| 5,297,567 | 3/1994 | Summerville et al. | 132/227 |
| 5,300,104 | 4/1994 | Gaudreault et al. | 607/114 |
| 5,411,040 | 5/1995 | Forrest | 132/246 |
| 5,571,155 | 11/1996 | Bastlille | 607/114 |
| 5,694,955 | 12/1997 | Grooms | 132/247 |
| 5,711,324 | 1/1998 | Johnson et al. | 132/252 |
| 5,819,763 | 10/1998 | Halowell . | |

FOREIGN PATENT DOCUMENTS 441584 8/1935 United Kingdom .

*Primary Examiner*—John J. Wilson
*Assistant Examiner*—Robyn Kieu Doan
*Attorney, Agent, or Firm*—Robert E. Howard

[57] ABSTRACT

A hair curler comprised of a flexible hollow tube, the interior of which contains heat absorbent material. The heat absorbent material is capable of being heated in a microwave oven to elevated temperatures, and capable of maintaining such elevated temperatures for a substantial period of time. The tube has ties attached to both ends for securing the tube in place on the head of a user after hair has been wrapped around it for curling. The tube is preferably constructed of a rubberized fabric having a plurality of protrusions extending from the outer surface thereof. The heat absorbent material is preferably a cereal grain, such as rice.

9 Claims, 1 Drawing Sheet

HAIR CURLER

CROSS-REFERENCE TO RELATED APPLICATIONS

This application claims the benefit of U.S. Provisional Application No. 60/105,761 filed Oct. 26, 1998, the entire disclosure of which is hereby incorporated by reference.

BACKGROUND OF THE INVENTION

This invention relates to a heatable hair curler. More particularly, this invention relates to a hair curler composed of material that can be easily heated in a microwave oven and retain its heat for a sufficient period of time to effect hair curling.

Hair curlers in common use are generally cylindrical spools having hollow cores that are heated by placing the spools over electrically heated posts. Such curlers require lengthy heat-up times and require specialized heaters.

More recently, it has been suggested to use hair curlers designed to be heated in a microwave oven in order to speed up the heating process.

For example, U.S. Pat. No. 4,538,630 discloses a plastic spool-type hair curler that can be heated in a microwave oven where the curler contains a "lossy dielectric material" to assist in the heating. The "lossy dielectric material" is described as being a ferrite material. The spool also contains a heat sink material, such as waxes, caustic soda, and metal salts.

U.S. Pat. No. 4,710,609 discloses a plastic spool-type hair curler that can be heated in a microwave oven where the spool has a mass of wicking material, such as foam rubber, to which water is added. Excess steam generated during microwave heating is vented to prevent explosions.

SUMMARY OF THE INVENTION

It is an object of this invention to provide a hair curler that is easy and safe to use.

The invention is a hair curler comprised of a hollow tube that preferably has an outer surface adapted to grip hair, the interior of which tube contains a heatable material capable of being heated to an elevated temperature in a microwave oven or other heat source, and capable of substantially maintaining such elevated temperature for a period of time sufficient to curl hair wrapped around the tube.

The tube is preferably flexible, and has an outer surface around which hair is wrapped for curling. The tube is preferably constructed of a rubberized cloth, and most preferably a rubberized cloth having a plurality of small, dimple-like protrusions extending from the outer surface.

The tube has flexible ties extending from both ends thereof, the ties being used to secure the tube in place after hair has been wrapped around it for curling.

DESCRIPTION OF PREFERRED EMBODIMENTS

Figure 1:
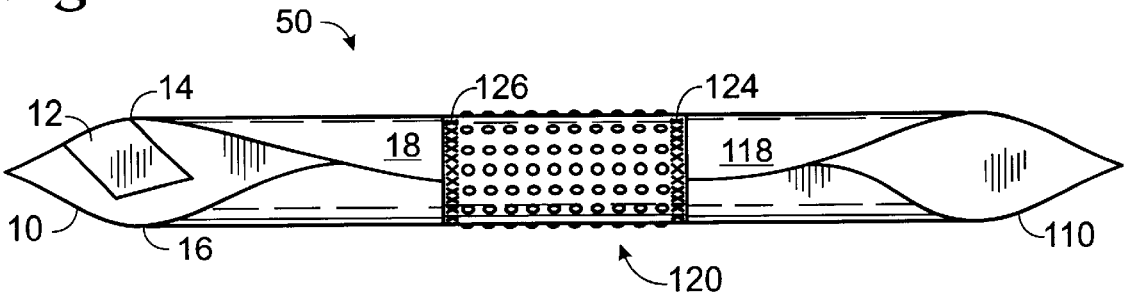
FIG. 1 is a top view of the hair curler of the invention.

The invention will be described with reference to the drawings. In the drawings:

10 is the triangular-shaped outer end of the first tie piece

12 is a label sewed to the outer end of the first tie piece

14 is one corner of the outer end of the first tie piece

16 is the other corner of the outer end of the first tie piece

18 is the first tie piece in its final, folded position

20 is a rectangular piece of rubberized fabric ("Jiffy Grip")

22 is the base sheet of the rubberized fabric

24 are protrusions extending from the base sheet of the rubberized fabric

26 is a line of stitches attaching the end piece of the tie to the rubberized fabric

32 is a tube filled with heat absorbent material

40 is a hook body

42 is the hooked end of the hook body

44 is the top end of the hook body

50 is the heatable hair curler of the invention

110 is the triangular-shaped outer end of the second tie piece

118 is the second tie piece in its final, folded position

120 is a tube formed of rubberized fabric (Jiffy Grip)

122 is a longitudinal row of stitches used to hold the tube 120 together

124 is a row of stitches used to secure one end of the tube 120

126 is a row of stitches used to secure the other end of the tube 120

The heatable hair curler 50 of the invention is shown in FIG. 1. The hair curler 50 has a middle section comprised of a flexible tube of rubberized fabric ("Jiffy Grip") 120 inside of which is located a tube of cloth 32 filled with a material that is microwave heatable and that can retain heat for a period of time sufficient to effect hair curling.

A preferred such microwave heatable material is rice.

First and second tie pieces 18 and 118 having an outer ends 10 and 110, respectively, are attached to opposite ends of rubberized fabric tube 120 in a manner to be described below. The tie pieces 18 and 118 are made of cloth and are used to secure the heated middle portion 120 to the head of a person using the curler 50.

The heatable hair curler 50 is assembled as follows. The flexible material (such as cloth) that is to form tie pieces 18 and 118 have first and second ends 10 and 110, respectively. The manner of folding the flexible material to form tie piece 18 will be described relative to outer end 10 of first tie 18, but it is to be understood that the same procedure would be used in folding the outer end 110 of second tie 118.

Both sides of the flexible material forming tie piece 18 are folded toward the center of the tie piece at corners 14 and 16 to form the final, folded tie piece 18 as shown in the drawings.

Figure 2:
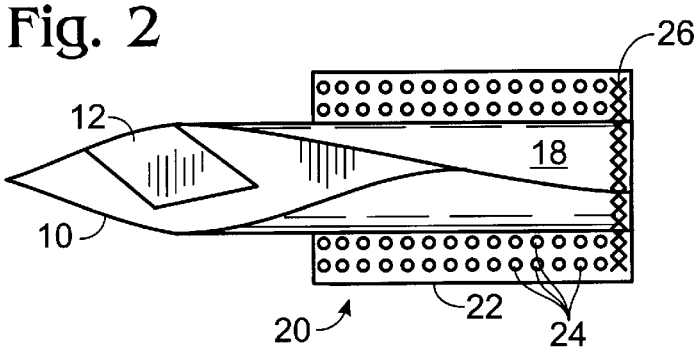
FIG. 2 is a partial top view of one of the tie pieces being attached to a piece of rubberized fabric during assembly.

The folded tie piece 18 is then attached to a rectangular piece of rubberized fabric ("Jiffy Grip") 20, as shown in FIG. 2, by sewing along stitch line 26. The rubberized fabric piece 20 is then folded down and away from stitch line 26 so that the smooth side would be facing out, and the other folded tie piece 118 sewn to the other end in the same manner as tie piece 18.

"Jiffy Grip" is a rubberized piece of cloth having a base sheet 22. One planar surface of base sheet 22 is smooth, the opposite planar surface having a plurality of non-slipping protuberances 24 projecting therefrom. The protuberances 24 are, essentially, small hemispheres having a diameter and a height of about 0.125 inch, the protuberances being spaced apart a distance of about 0.19 inch (center to center).

Although "Jiffy Grip" is the preferred material used in forming flexible tube 120, other materials may be used, including materials where both planar surfaces are smooth.

Protuberances 24 may have shapes other than hemispherical, such as small cylindrical fingers.

Figure 3:
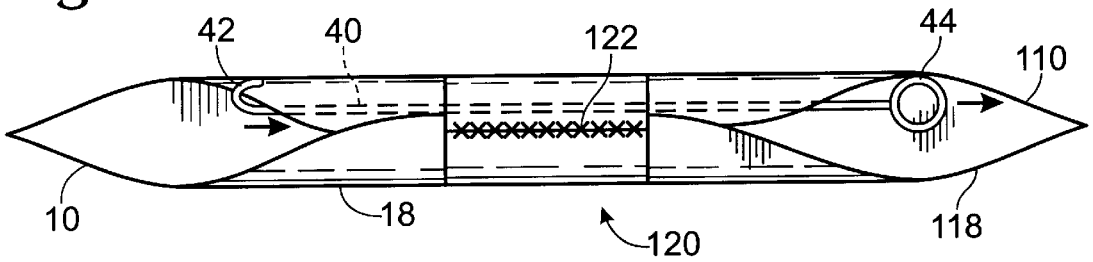
FIG. 3 is a top view of the hair curler during assembly.

After first and second tie pieces 18 and 118 are attached to opposite ends of the rectangular piece of rubberized fabric 20, the rubberized fabric piece 20 is rolled into a tube 120, with protuberances 24 facing inward, i.e., smooth side out, and sewn along the joint at longitudinal stitch line 122, as seen in FIG. 3.

Figure 4:
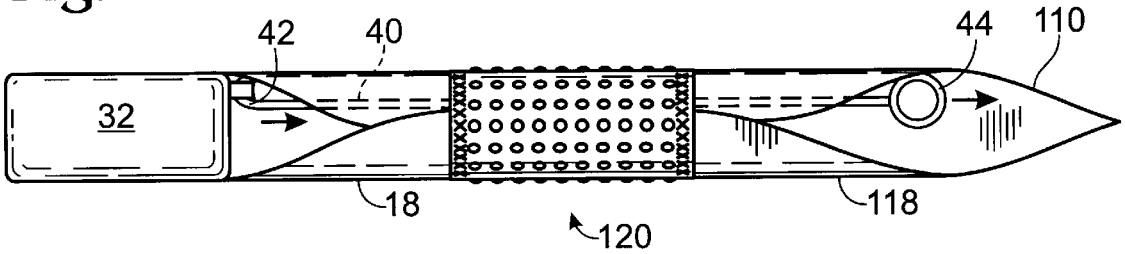
FIG. 4 is a top view of the heat absorbent material being inserted into the hair curler during assembly.

Tube 120 is then turned inside out so that protuberances 24 now face outwardly, as seen in FIGS. 1 and 4. One method of effecting this operation is to use a hook 40, as shown in FIG. 3. It is easier to effect this operation if a small tube is first inserted through tube 120. Other ways of effecting this operation may be used.

A tube 32 is formed by folding a rectangular piece of cloth or other microwavable material into a tube and sealing the folded tube along the bottom and longitudinal side, such as by stitching. The tube 32 thus formed is then filled with rice or other microwave heatable material, and the upper end is then sealed shut.

The filled cloth tube 32 is then inserted into the interior of the rubberized fabric tube 120 by use of hook 40, as shown in FIG. 4. This insertion is facilitated by first inserting a small tube into tube 120. The rubberized fabric tube 120 is then sewn shut on each end along stitch lines 124 and 126 to complete the assembly of the heatable hair curler 50 of the invention.

In operation, the heatable hair curler 50 of the invention is inserted into a microwave oven, and heated for a period of time sufficient to heat the rice filler to a hair curling temperature. The hair curler 50 is then removed from the microwave oven and hair to be curled wrapped around the heated tube portion 120. Ties 18 and 118 are then tied together to secure the curler 50 to the head. The rice filler has been found to act as a heat sink and retains heat for a sufficient period of time after microwave heating to accomplish its hair curling function.

Stitching has been described as the preferred method of attaching and sealing various components of the invention. However, it is clear that other methods of attachment and/or sealing may be used, such as stapling, snapping, gluing, hook and loop fastening means ("Velcro"), etc.

Although rice has been described as the preferred microwave heatable material used to fill cloth tube 32, other cereal grains such as buckwheat, corn, etc., or other natural materials, may be used, so long as such material has the property of being able to be heated to a hair curling temperature and to retain heat (i.e., act as a heat sink) for a sufficient period of time to substantially effect the hair curling function.

As an alternative to natural microwave heatable materials, man made microwave heatable materials may also be used, such as those used in "hot/cold" packs or "gel packs".

Disposable curlers may be made by using exothermic reaction chemicals, such as, for example, those used in ready to eat meals prepared for the armed forces, or such as disclosed in U.S. Pat. No. 3,328,136. Such chemicals are kept separate from each other with at least one such chemical being located in a pressure puncturable pouch, and produce heat by puncturing the pouch to permit the chemicals to intermix. Where such materials are used, tube 20 would be made of a leakproof and chemical resistant material, such as a plastic.

If desired, aromatic materials, such as pleasant smelling oils, perfumes, powders, herbs, etc., can be added to cause the curler to impart a pleasing smell to the hair during use.

The curler may be heated by heating means other than a microwave oven, such as a conventional oven; however, a microwave oven and microwave heatable materials are preferred because of the time savings.

The tube portion 120 of curler 50 of the invention can be made of any suitable length. It is preferred to use a length of between about 5 and about 8 inches, most preferably between about 7.5 to about 8.0 inches. Such a length permits the use of fewer curlers than those in common use. However, shorter lengths of about 1.5 inches would be used for curlers used for curling bangs.

The flexible ties 18 and 118 of the curler 50 may be made of any natural or man made fiber, such as cotton. The ties may be made of cloth or rope-like material. The length of ties 18 and 118 are selected to allow easy tying of the hair curler in place on the hair of a user. The ties also add a decorative feature to the curler.

The invention claimed is:

1. A heatable hair curler comprising a hollow tube, said hollow tube being wrapped with rubberized cloth having hemispherical protrusions extending from the outer surface thereof, each end of the rubberized cloth wrapped hollow tube being attached to an individual cloth tying member, the interior of said hollow tube containing a heatable material capable of being heated to elevated temperatures sufficient to curl hair.

2. The hair curler of claim 1 wherein said heatable material is a microwave heatable material.

3. The hair curler of claim 1 wherein said heatable material is a cereal grain.

4. The hair curler of claim 1 wherein said cereal grain is rice.

5. The hair curler of claim 1 wherein said heatable material is a heatable gel.

6. The hair curler of claim 1 wherein said heatable material is comprised of chemicals which produce an exothermic reaction when mixed together.

7. The hair curler of claim 1 wherein said curler contains a pleasant smelling aromatic material.

8. The hair curler of claim 1 wherein said hemispherical protrusions have a height above said outer surface of about 0.125 inch.

9. The hair curler of claim 8 wherein said hemispherical protrusions are spaced apart a distance of about 0.19 inch, center to center.

* * * * *